United States Patent [19]

Cavalli

[11] Patent Number: 4,535,556

[45] Date of Patent: Aug. 20, 1985

[54] STEAM IRONING APPARATUS WITH A SEPARATE WATER RESERVOIR

[76] Inventor: Alfredo Cavalli, 9, Via G. Galilei, Pessano Con Bornago, Milan, Italy

[21] Appl. No.: 582,461

[22] Filed: Feb. 22, 1984

[30] Foreign Application Priority Data

Mar. 1, 1983 [IT] Italy ..... 20966/83[U]
Mar. 22, 1983 [IT] Italy ..... 21223/83[U]

[51] Int. Cl.[3] ..... D06F 75/12
[52] U.S. Cl. ..... 38/77.6; 38/77.8
[58] Field of Search ..... 38/77.3, 77.6, 77.8

[56] References Cited

U.S. PATENT DOCUMENTS 1,180,114 4/1916 Durand ..... 38/77.6
1,299,036 4/1919 Rotnagle ..... 38/77.6 X
2,294,578 9/1942 Shapiro et al. ..... 38/77.6
2,634,526 4/1953 McGraw ..... 38/77.3

FOREIGN PATENT DOCUMENTS 2650837 11/1977 Fed. Rep. of Germany ..... 38/77.8

*Primary Examiner*—Werner H. Schroeder
*Assistant Examiner*—Andrew M. Falik
*Attorney, Agent, or Firm*—Cohen, Pontani & Lieberman

[57] ABSTRACT

Steam ironing apparatus comprises a steam iron, the body of which is formed with a steam generating evaporation chamber communicating with a plurality of through holes formed in the plate of the iron. A unit for supplying water to the steam generating chamber includes a water reservoir structurally independent of the iron, a duct for supplying water from the reservoir to the evaporation chamber and a cut-off valve carried by the iron and operable by a manual control located on the hand-grip of the iron to control the supply of water through the duct to the steam generating chamber.

6 Claims, 4 Drawing Figures

STEAM IRONING APPARATUS WITH A SEPARATE WATER RESERVOIR

The present invention relates to steam ironing apparatus comprising a steam iron, the body of which is formed with a steam generating chamber or evaporation chamber having fluid communication with a plurality of through holes formed in the plate of the iron, and a unit for supplying water to the evaporation chamber of the steam iron.

Such apparatus is particularly but not exclusively intended for domestic use.

Known steam irons of the type under consideration are formed or otherwise incorporate, in addition to the steam generating chamber, a water reservoir for supplying the chamber through a so-called water-droplet valve. When this valve is operated by the user of the steam iron, water droplets of larger or smaller size, but always consistent, are made to fall onto the bottom of the evaporation chamber, the bottom generally being constituted by a portion of the steam iron plate itself.

A first known disadvantage of steam irons of the type under consideration is the small size and hence small capacity of the water reservoir, which limits the independent operation of the steam iron. Consequently the user of the steam iron has to interrupt the ironing frequently in order to restore the water level in the reservoir.

A second disadvantage, which cannot be neglected particularly from the safety aspect, is due to the presence of water or humidity in the steam iron, which carries and/or incorporates numerous significant electrical components.

A disadvantage of a strictly technical character resides in the impossibility of regulating the quantity of water reaching the evaporation chamber and hence of regulating the volume of steam generated and supplied.

A further disadvantage is the fact that the water droplets gradually fed into the evaporation chamber do not evaporate completely, whereby a more or less considerable quantity of liquid water may also be supplied with the steam, which water, as is known, leaves visible traces (moisture marks) on the ironed articles.

The main object of the present invention is to overcome these and other disadvantages of prior art steam irons.

This object, and others which will become more apparent from the following description, is achieved by the fact that the supply unit comprises a water reservoir which is structurally independent of the steam iron, a liquid communication duct between the reservoir and the evaporation chamber of the steam iron, a cut-off valve member for the water flow in the duct, supported in the steam iron and operated by a manual control located on the iron.

In accordance with a second characteristic of the invention, the unit for supplying water to the evaporation chamber includes a pump in the said duct, which is rendered operative by the same manual control as operates the cut-off valve member.

Further characteristics and advantages will become more apparent from the detailed description of one embodiment of an apparatus for steam ironing according to the invention, made below with reference to the appended drawings, given purely by way of example, in which.

Figure 1:
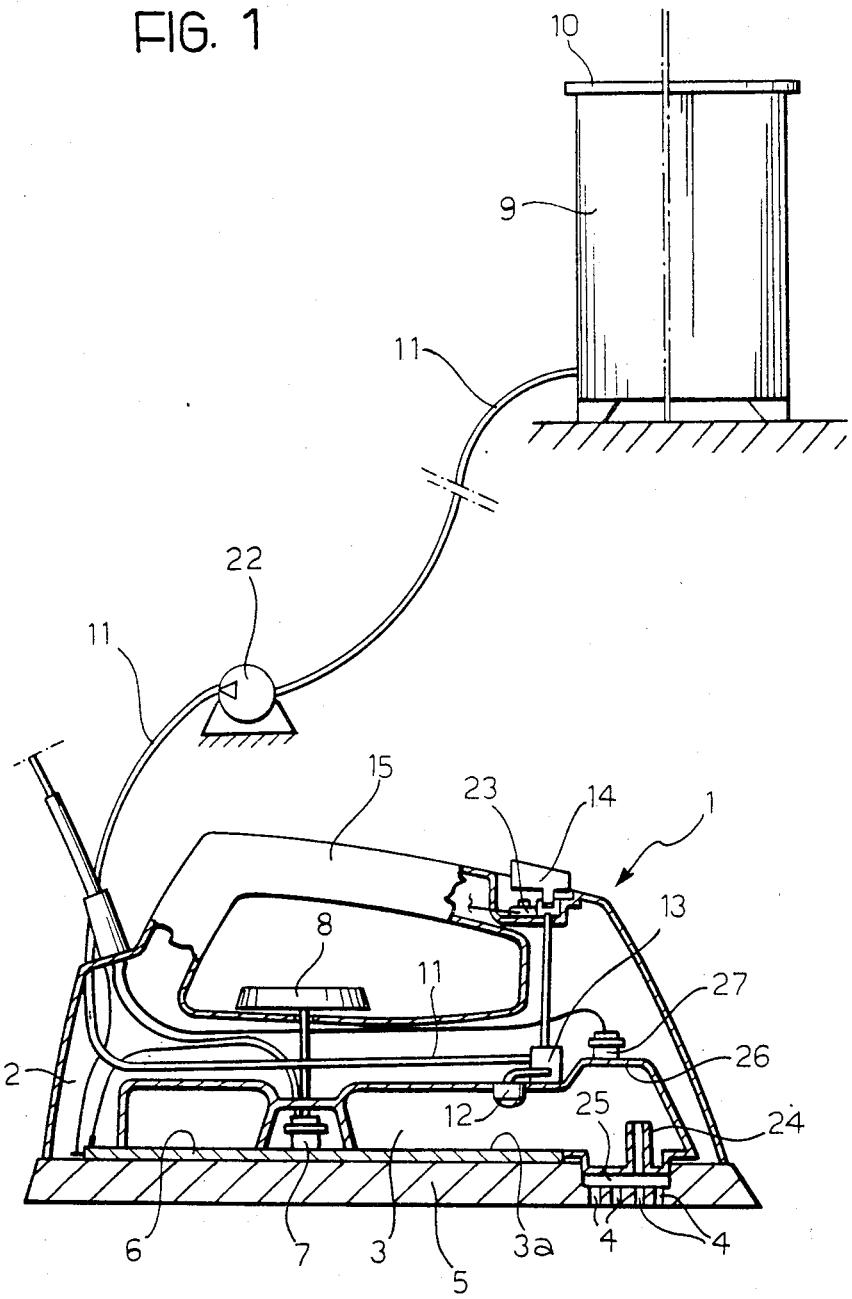
FIG. 1 is a schematic partially sectioned view of apparatus for steam ironing according to the invention.
Figure 2:
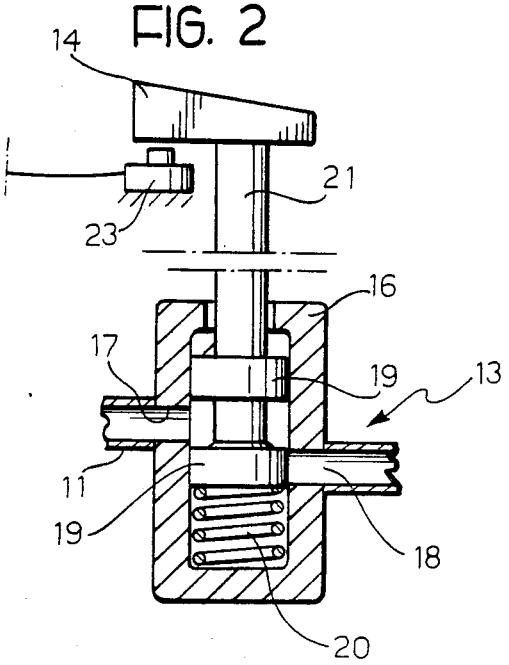
FIG. 2 is a schematic sectional view of a cut-off valve member used in the steam iron of the apparatus of the invention.

With reference to FIGS. 1 and 2 steam ironing apparatus according to the invention comprises a steam iron schematically indicated as 1, the body 2 of which is formed with an evaporation or steam generating chamber 3. This evaporation chamber 3 is in fluid communication in the manner described below with a plurality of through holes 4 formed in the plate 5 of the steam iron. The plate 5 is heated in a conventional manner by means of electrical resistances 6, for example, and preferably laminar type electrical resistances. The temperature of the plate 5 is predetermined and regulated by means of a thermostat 7 controlled by a knob 8 carried by the steam iron 1 and operated manually by the user thereof.

A water reservoir is generally indicated 9 and may be of the open topped type or its top may be closed by a removable lid 10. The reservoir 9, which is structurally independent of the steam iron 1, is in liquid communication with the evaporation chamber 3 of the iron 1 through a flexible tube 11 of the conventional type used for supplying water under pressure. Within the body 2 of the steam iron the tube 11 is connected to a spray nozzle 12 (preferably an atomizer nozzle) through a cut-off valve member generally indicated 13 in FIG. 1. This valve member 13 is operated by a manual control 14 accessible on the hand-grip 15 of the steam iron under consideration.

With reference to FIG. 2, the valve member 13 is essentially of the spool distributor type comprising a valve body 16 having an inlet port 17 to which the end of the tube 11 is connected and an outlet port 18 in liquid communication with the said spray nozzle 12. A valve slide 19 (spool) is movable axially against resilient means 20 in the valve body 16 from a position in which the ports are in mutual communication to a position in which this communication is cut-off. The slide 19 is operated by the control 14 through a rod 21 guided for sliding movement in the body 2 of the steam iron.

A pump 22 is inserted in the tube 11 for supplying water from the reservoir 9 to the spray nozzle 12 when required. This pump is rendered operative by the same push-button control 14 which operates the cut-off valve member 13. For this purpose a switch 23 is provided in a conventional electrical circuit, shown in broken outline, for operating the pump 22 and is supported in the hand-grip 15 of the steam iron in a position such as to be operated by the control 14 when communication between the inlet port 17 and outlet port 18 of the valve member 13 has been opened by this same control.

The evaporation chamber 3 has a base 3*a* structurally independent of the plate 5 of the steam iron 1 and can effectively be considered as a small boiler. Steam communication between the chamber 3 and the plurality of through holes 4 in the plate 5 is afforded by a duct 24 which extends into the chamber 3 and has an open upper end close to the top thereof. The other end of the duct 24 opens outside the chamber 3 into a recess 25 formed in the plate 5 which constitutes essentially a steam manifold for the plurality of holes 4.

The presence of the steam outlet duct 24 is such as to ensure that any water which may not have evaporated in the chamber 3 is not supplied together with the steam. In order further to guarantee this, a small steam dome 26 is formed in the chamber 3, the upper end of the duct 24 opening into this.

Again in correspondence with the dome 26, a thermostat 27 is mounted on the evaporation chamber 3 for inhibiting the operation of pump 22 until the temperature in the evaporation chamber 3 has reached an appropriate predetermined value.

The advantages achieved by the steam ironing apparatus described above with reference to FIGS. 1 and 2 consist of an increased independence of operation of the steam iron, increased safety in operation due to the absence of water in the steam iron, and the possibility of regulating the the quantity of liquid supplied to the evaporation chamber, and hence of controlling the volume of steam produced and supplied by the iron. A further advantage resides in the instantaneous production of steam achieved by means of the use of a spray nozzle, and preferably an atomizer, for supplying the water to the evaporation chamber 3.

A further advantage lies in the fact that the evaporation chamber is in fact a small boiler from which the steam generated is withdrawn via the steam dome, ensuring the absence of entrained liquid water.

Although the use of a pump for supplying water from the reservoir 9 to the evaporation chamber 3, is particularly preferred, the said supply could alternatively be achieved simply by gravity, by arranging for the reservoir 9 to be located at a suitable level above the working or ironing plane.

Figure 3:
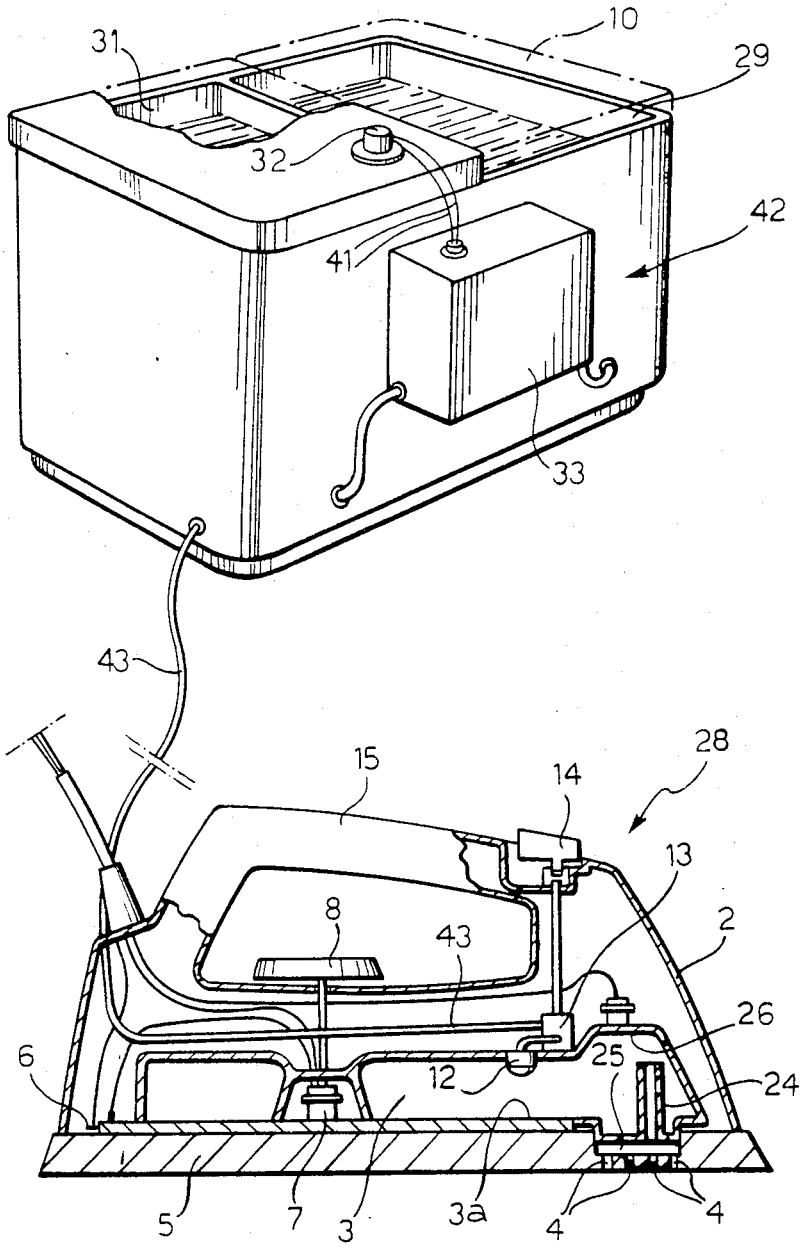
FIG. 3 is a schematic partially sectioned view of a variant of the apparatus for steam ironing of the invention.

In the variant embodiment of FIG. 3, a steam ironing apparatus comprises a steam iron 28 which is substantially the same as the steam iron 1 described with reference to FIGS. 1 and 2. For the purpose of simplification all of the components of the steam iron 28 which are the same as those of the steam iron 1 are indicated by the same reference numerals.

According to this variant embodiment, the ironing apparatus comprises a first water reservoir 29 which may be open topped or may have its top closed by a removable lid 10. The reservoir 29, which is at atmospheric pressure, is structurally independent of the steam iron 28.

Figure 4:
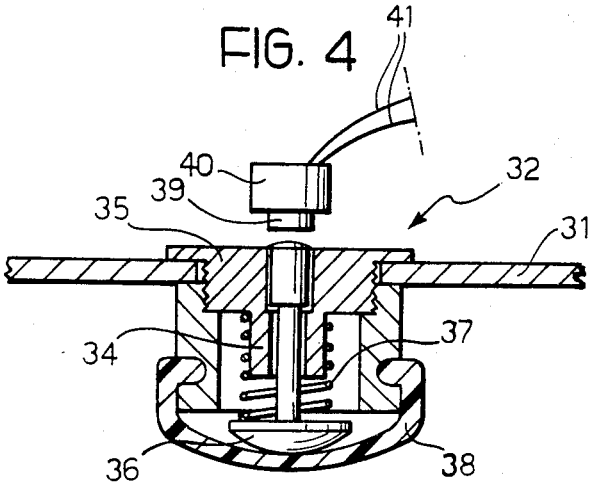
FIG. 4 shows a detail of FIG. 3 on an enlarged scale.

A pressurized water reservoir (autoclave) is indicated 31 and is also structurally independent of the steam iron 28. A pump 33 supplies water from the reservoir 29 to the reservoir 31 to keep the pressure in the latter within a predetermined sufficiently narrow range. The pump 33 is rendered operative by a pressure sensor member schematically shown at 32 (a pressostat) of conventional type. For example in FIG. 4 such a pressostat is of the type including a shaft 34, preferably axially guided in an essentially plug-like support 35 fixed in a wall, preferably in the upper wall, of the pressurized reservoir 31. At the end of the shaft 34 within the reservoir 31 there is fixed or otherwise formed a mushroom head 36 acted upon on one side by a calibrated spring 37 and on the other side enclosed in a membrane 38 subject to the pressure existing in the reservoir 31. The other end of the shaft 34 is aligned with a push-button 39 of a switch 40 connected in the electrical circuit schematically shown at 41 for operating the pump 33. Under normal conditions of operation, that is to say when the pressure in the reservoir 31 has the predetermined value or is at least within the predetermined range of values, the shaft 34 is in pressure contact with the push-button 39, opposing the action of the spring 37. Under these conditions the electrical circuit 41 is open and the pump 33 is not operative. When the pressure in the reservoir 31 falls below the predetermined value, the action of the spring 37 on the shaft 34 becomes prevalent, whereupon the shaft is moved away from the push-button 39. Consequently the pump 33, rendered operative, supplies water from the reservoir 29 to the reservoir 31.

In accordance with a preferred, but non-limitative embodiment, the reservoir 29 and the reservoir 31 are formed in a single container 42 while the pump 33 is fixed to the outside of the container 42 in a suitable position thereon. The pressurized reservoir 31 is in liquid communication through a flexible tube 43 with the evaporation chamber 3 of the steam iron 28.

I claim:

1. Steam ironing apparatus comprising a steam iron having a body provided with a hand-grip, a steam generating evaporation chamber within said body, an ironing plate attached to said body and provided with a plurality of through holes in fluid communication with said chamber, and a unit for supplying water to said steam generating chamber wherein the improvements consist in said unit comprising:

a water reservoir structurally independent of said iron;

a water supply duct providing liquid communication between said reservoir and said steam generating chamber in said steam iron;

a cut-off valve carried by said steam iron and connected in said duct, a manual valve control located on said hand-grip of said steam iron and operatively connected to said valve for operating the latter;

a pump in said duct operatively connected to said manual control so as to be rendered operative when said cut-off valve is opened; and a spray nozzle connected within the body of said steam iron to said water supply duct through said cut-off valve, said spray nozzle being disposed in said steam generating chamber to supply liquid thereto in spray form; said ironing plate being provided with a recessed steam manifold communicating with said steam generating chamber having a base which is structurally independent of said ironing plate and being povided internally with a steam duct having an open end close to the top of said chamber, the other end of said steam duct opening outside the chamber into said steam manifold.

2. Apparatus as defined in claim 1, including a small steam dome formed in said steam generating evaporation chamber, the upper end of the steam duct communicating with said dome.

3. Steam ironing apparatus comprising a steam iron having a body provided with a hand-grip, a steam generating evaporation chamber within said body, an ironing plate attached to said body and provided with a plurality of through holes in fluid communication with said chamber, and a unit for supplying water to said steam generating chamber wherein the improvements consist in said unit comprising:

a water reservoir structurally independent of said iron;

a water supply duct providing liquid communication between said reservoir and said steam generating chamber in said steam iron;

a cut-off valve carried by said steam iron and connected in said duct, a manual valve control located on said hand-grip of said steam iron and operatively connected to said value for operating the latter; and a further pressurized water reservoir which is structurally independent of said steam iron and is provided with a pressure sensor member, and a pump operatively controlled by said pressure sensor member for supplying water from said reservoir to said further reservoir, said water supply duct affording communication between said further reservoir and said steam generating evaporation chamber.

4. Apparatus as defined in claim 3, wherein said reservoir and said further reservoir are housed in a single container constituting a unit which is independently hand-portable.

5. Apparatus as defined in claim 4, wherein said pump is fixed to the exterior of the container.

6. Apparatus as defined in claim 5, wherein a small steam dome is formed in the tops of said evaporation chamber and wherein said steam generating evaporation chamber has a bottom which is structurally independent of said ironing plate and is provided internally with a steam duct having one end opening close to said steam dome in the top of said evaporation chamber, the other end of said duct opening externally of said chamber into a recess in said ironing plate constituting a steam manifold communicating with said plurality of through holes.

* * * * *